US006494669B2

(12) United States Patent
Bernard et al.

(10) Patent No.: US 6,494,669 B2
(45) Date of Patent: Dec. 17, 2002

(54) POINT-OF-SALES RUG DISPLAY DEVICE

(76) Inventors: André Bernard, Five Kitchel Rd., Mt. Kisco, NY (US) 10549; Scott Bernard, Five Kitchel Rd., Mt. Kisco, NY (US) 10549

( * ) Notice: Subject to any disclaimer, the term of this patent is extended or adjusted under 35 U.S.C. 154(b) by 148 days.

(21) Appl. No.: 09/729,122

(22) Filed: Dec. 4, 2000

(65) Prior Publication Data

US 2002/0066217 A1 Jun. 6, 2002

(51) Int. Cl.[7] ..... B66F 11/00
(52) U.S. Cl. ..... 414/800; 108/147; 312/306
(58) Field of Search ..... 414/331.14, 800; 312/312, 306, 319.5, 319.6, 319.7, 319.8; 108/20, 21, 106, 47, 147.12

(56) References Cited

U.S. PATENT DOCUMENTS 1,779,004 A * 10/1930 Krell ..... 312/272
2,802,575 A * 8/1957 Harrison ..... 108/106
3,339,795 A * 9/1967 Cappel ..... 312/306
4,790,611 A * 12/1988 Craner ..... 108/147
5,129,611 A * 7/1992 Grover et al. ..... 108/147
5,152,590 A * 10/1992 Dukes ..... 312/306

FOREIGN PATENT DOCUMENTS

JP 03-277314 * 12/1991 ..... A47B/81/06

* cited by examiner

*Primary Examiner*—Kathy Matecki
*Assistant Examiner*—Michael J. Kwon

(57) ABSTRACT

For a point-of-sales rug selection from a stack thereof, a method of working a raised stack from the bottom up so that a rug assuming successively the bottom position is permitted to descend, each in turn, to a floor display position and, after the first descent using lowering cables, the cables having a length portion in a taut vertical condition to serve as tracking guides for the vertical descent by gravity of successive rugs.

1 Claim, 3 Drawing Sheets

POINT-OF-SALES RUG DISPLAY DEVICE

The present invention relates generally to a point-of-sales rug display device in the operating mode of which, from a stack of rugs, one rug at a time is separated from the stack and displayed to a prospective customer, thereby obviating the heretofore necessity to exert a great deal of physical effort in unrolling or moving rugs by hand so that. the successive rugs might be seen, and for which usually the services of two or more men are needed for this purpose.

EXAMPLES OF THE PRIOR ART

The replacement by automation of the hand manipulation of rugs to facilitate customer selection is the focus of numerous prior patents, as exemplified by U.S. Pat. No. 2,577,366 for "Machine For Displaying Rugs" issued to E. Reiss et al. on Dec. 4, 1951 and U.S. Pat. No. 3,289,860 for "System For Handling Stacked Sheets" also applicable for rugs, issued to G. A. Dean on Jun. 9, 1964, to mention but a few.

In the aforesaid and all other known prior patents, the stack is worked from the top down, with each top rug removed to a clearance position exposing the next in line rug, until an exposed rug is satisfactory to a customer, removed and, of course, replaced, and the integrity of the stack restored to repeat the selection process. While the working of the stack from the top down involves only the handling of one rug, its removal to an out-of-way clearance position providing an unobstructed view of the next underlying rug is a complication which has resulted in a correspondingly complicated mechanism.

Broadly, it is an object of the present invention to provide an effective reverse order stack separation of successive rugs overcoming the foregoing and other shortcomings of the prior art.

More particularly, it is an object to raise the stack en masse and release from the bottom thereof, using to advantage guided gravity descent, to display at floor level successive rugs, all, as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
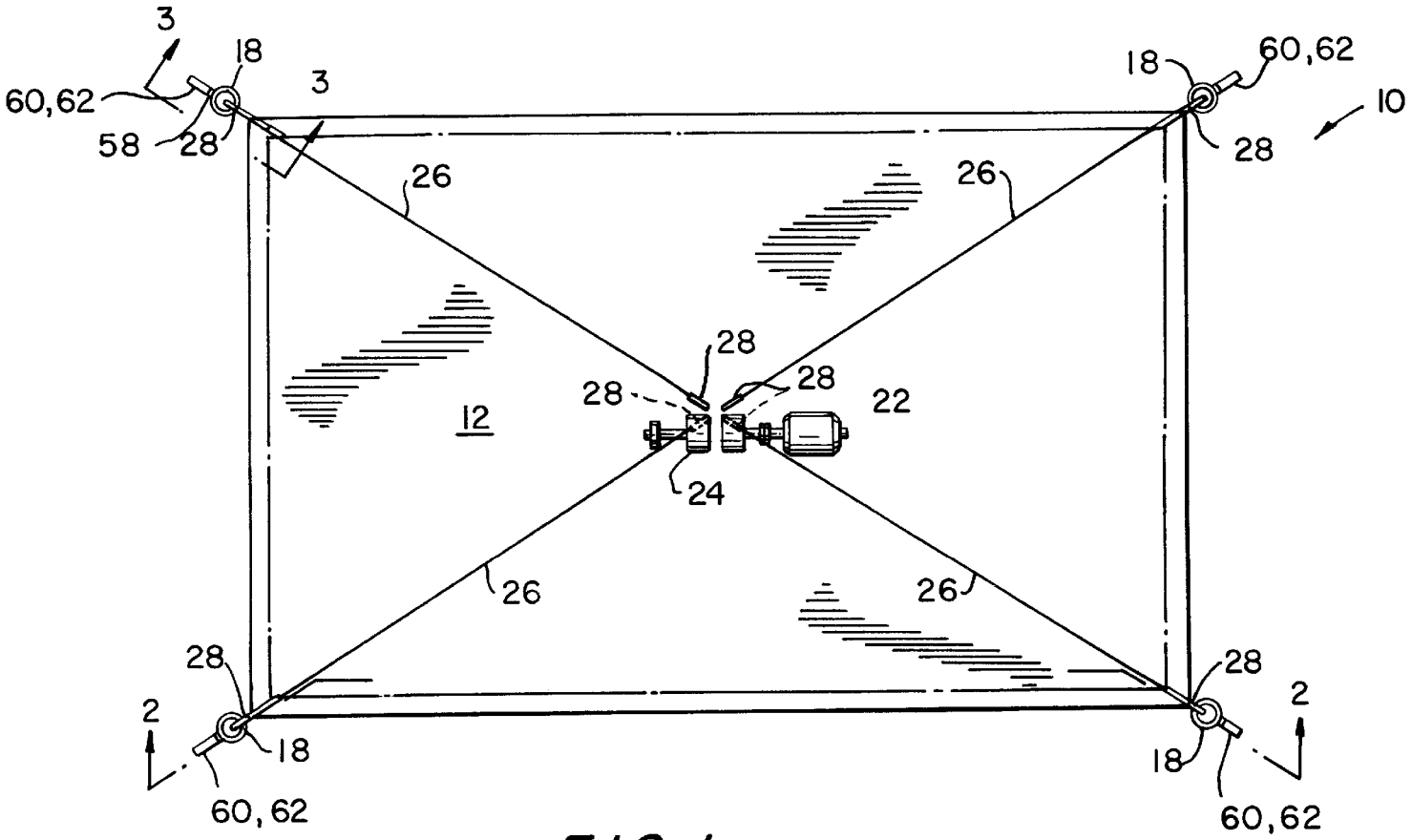
FIG. 1 is a plan view of a point-of-sales rug display device according to the present invention;.
Figure 2:
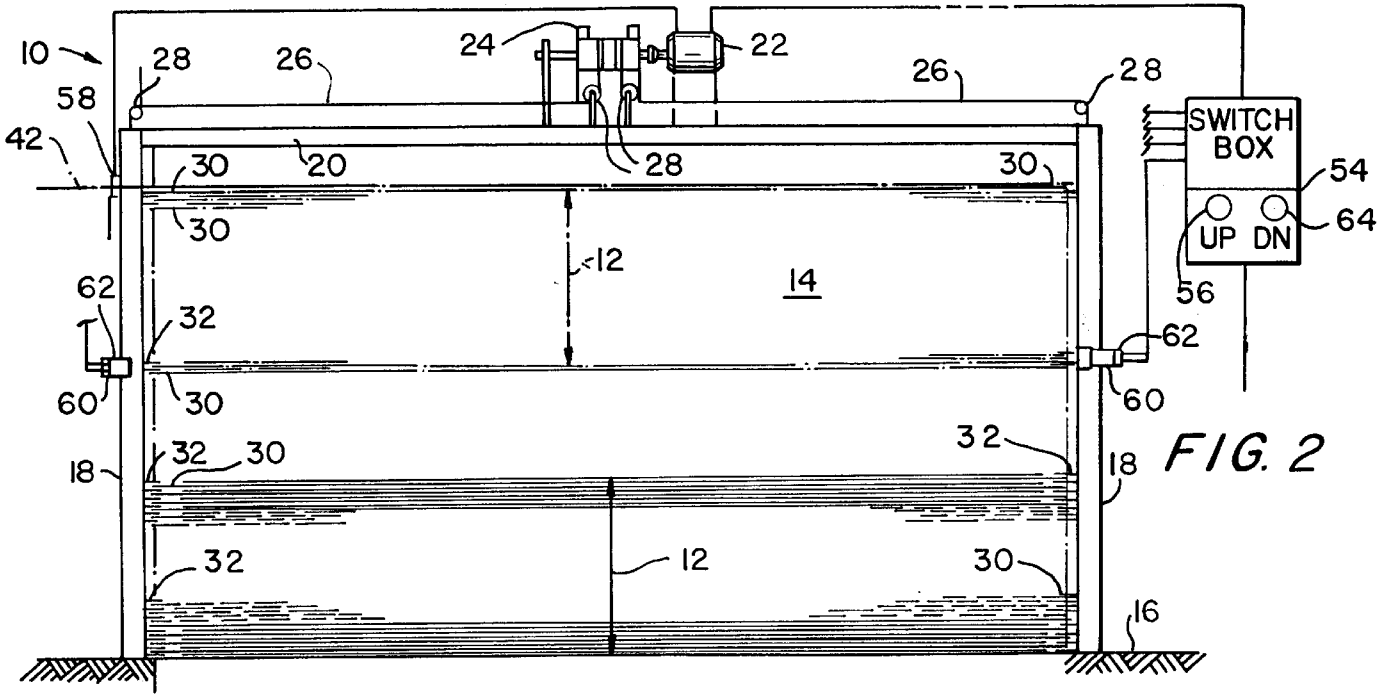
FIG. 2 is a side elevational view of the device of FIG. 1 as taken along line 2—2 of FIG. 1.

The point-of-sales rug display device shown and generally designated 10 in FIG. 1, is designed to handle, as best understood from FIG. 2, a stack 12 of rugs, preferably forty in number, which are raised as a stack preparatory to display one-at-time to a prospective customer, to an elevated clearance position 14 and lowered therefrom to a floor display site 16.

To the above end, device 10 has at least four comer, and possibly more, vertical columns 18 interconnected by cross beams or supports 20, only two of which are shown in FIG. 2, forming a rigid rectangular structure. Supported atop a support 20 in a medial location is a reversible motor 22 coupled to a drum 24 about which is a helically wound cable 26 entrained about pulleys 28 along paths to each column 18 for connection of the free ends of the cable to the rug stack 12.

Figure 4:
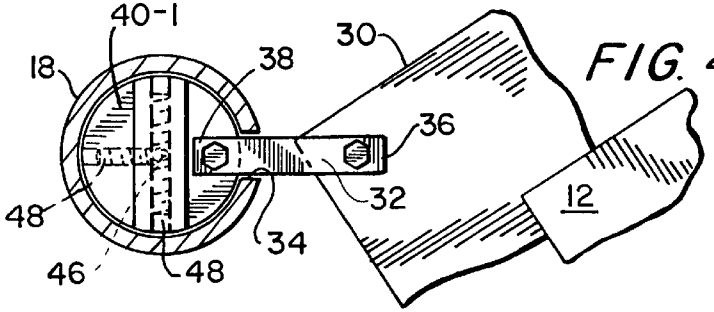
FIG. 4 is a cross section as taken along line 4—4 of FIG. 3.
Figure 3:
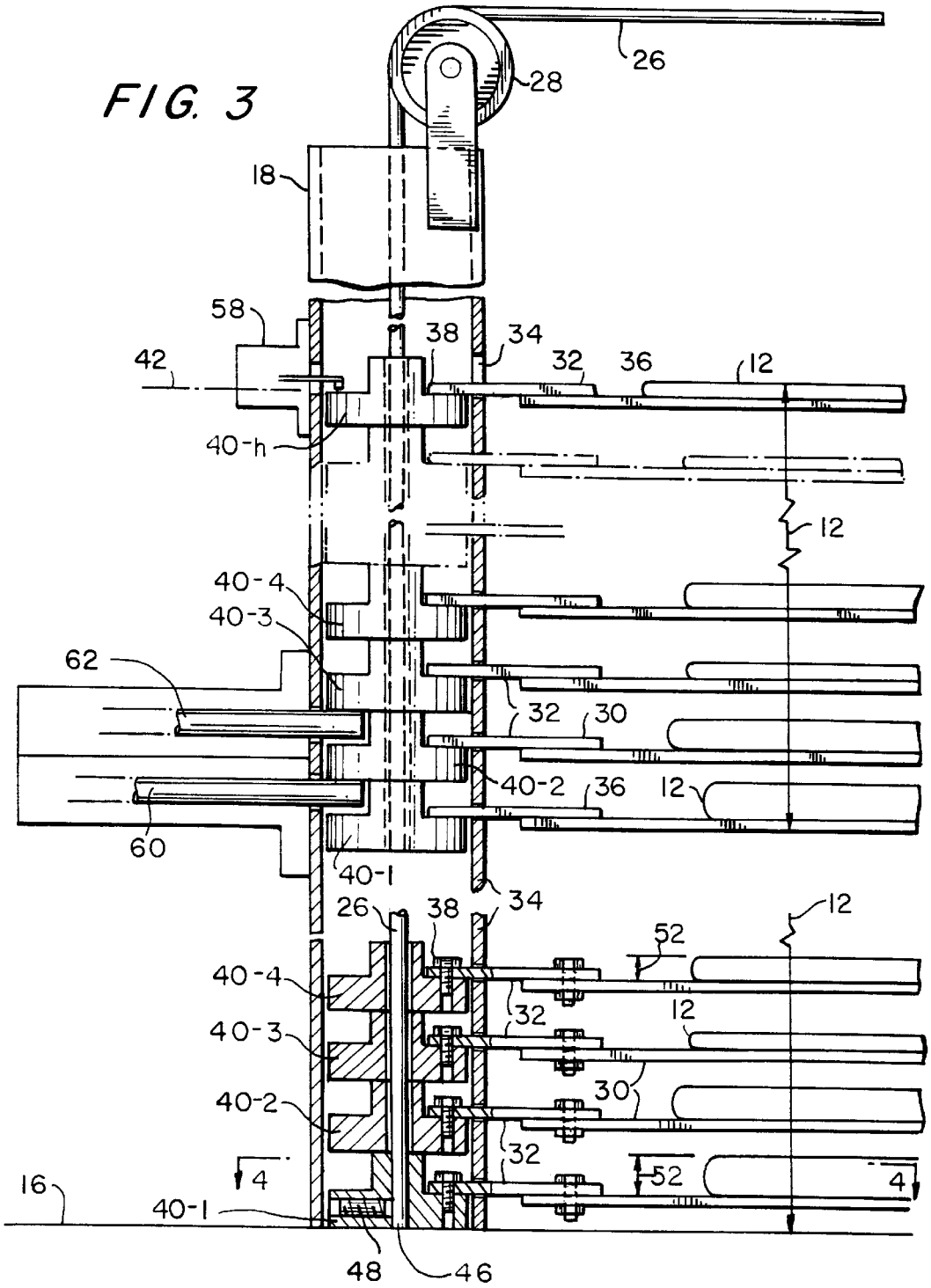
FIG. 3 is a cross section of a selected support column in the rear left corner location as taken along line 3—3 of FIG. 1.

Each rug, preferably 16'0" in size, is supported on a slightly oversized grid 30 of metal construction material, which, at each comer, has a link 32 (FIG. 4) horizontally oriented through a slot 34 of a wall of the column 18 is connected in spanning relation between an inboard end 36 connection to the grid 30 and an outboard end 38 connection to spacing collars, in four sets of forty, i.e. of a number corresponding in number to the rugs to be displayed, which collars are generally designated 40 in FIG. 3 and followed by consecutive numbers correlated to the description of the mode of use of the collars 40, which use basically is to track vertically in the columns 18 and, to this end, the collars 40 are appropriately sized and shaped relative to the size and shape of the hollow interiors of the column 18.

The tracking, according to the inventive operating mode of the device 10, is to allow release, starting from the bottom of the raised stack 12, one rug-supporting grid 30 at a time, so as to display each rug occupying the top of the stack at floor level to a prospective customer.

In the description which now follows of this operating mode, the assumed start is the stack 12 of the forty grid-supported rugs on the floor display site 16 and the raising of the stack to an appropriate clearance position 42 above the floor for a distance selected in part by the size of the rug, so that a clear view is provided a customer form the nearest to the farthest edge of the rug unobstructed by the raised stack, the position of the bottom rug of which does not change but the separating distance thereof from the floor site does not change, as the stack is built up by lowered rug-supported grids. Thus, the separating distance should be an extent so that at all times it provides a customer with a clear view of the top rug at floor level.

The lifting and releasing technique occurring in the rear left corner column 18 depicted in FIG. 3 will be understood to occur in coordinating relation in the other three columns.

The bottom positioned collar 40-1 (FIG. 5B) is attached to the cable free end and thus this collar has a throughbore 44 sized to receive the cable free end 46 and radial set screws 48 threaded to engage and clamp the collar 40-1 onto the cable 26.

Figure 5A:
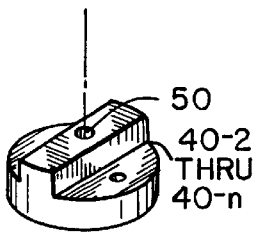
FIGS. 5A and 5B are detailed perspective views of lifting/release spacer, collars.
Figure 5B:
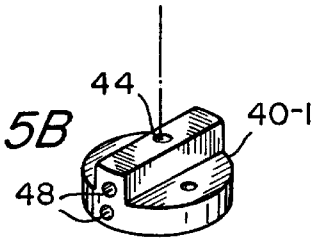

The collars 40-2 through 40-n (FIG. 5A) differ slightly in that the machined throughbores 50 thereof are slightly oversized in relation to the diameter of the cable 26 so that the cable with a collar 40 with attached rug-supported grid 30 can be lowered through the throughbores of collars 40-2 through 40-n and, most important, the released collars of FIG. 5A will partake of gravity descent and track along the lowered length of cable 26. Underlying the present invention is the recognition that the nature of a rug construction, namely, its thickness 52 provides the necessary shock-absorbing bulk to cushion the impact of the gravity descent.

Controls used during the operating mode are made accessible to a salesperson on a control panel 54 within reach of, or remotely actuated by, the salesperson.

The stack 12 on the floor is lifted by actuating a start button 56 of motor 22 which powers drum 24 in rotation and winds the cable 26 thereabout until a switch contact 58 in the path of ascent is contacted by the top of the raised stack 12 and, in a known manner, terminates motor operation. At this time, solenoid armatures 60 and 62 are retracted within their solenoids and thus clear of the path of ascent, but upon contact with switch contact 58 these armatures are extended to operative positions controlling sequential descent of the collars 40-2 through 40-n, starting with cellars 40-2 and 40-3 depicted in FIG. 3 with the armatures 60 and 62 blocking the descent thereof The release button 64 for reverse rotation of the motor 22 is actuated which unwinds the cable from the drum 24 and lowers the collar 40-1 with attached rug-supported grid away from its position adjacently below the restrained collar 40-2, the separating descent being allowed to occur until it is appropriately noted by switch contact (not shown) or by observation that the floor display site I(6 has been reached, at which time the motor operation is terminated.

If the rug oil the grid of collar 40-1 is not satisfactory to the customer, the collars of FIG. 5A are released for gravity descent to the floor site, one by one, by coordinated alternating operation of the armatures 60 and 62 between their retracted and extended positions. Thus, armature 60 is retracted while armature 62 remains extended, resulting in the separating release from the stack 12 only of collar 40-2 which, upon release, partakes of gravity descent tracking along cable 26 to the floor display site 16.

The armature 60 is then extended and armature 62 retracted, resulting in the lowering of the stack 12 by one collar, after which armature 62 is restored to its extended blocking position, and both armatures 60 and 62 are in their blocking positions as previously described, but this time exercising controlled release of collar 40-3 from collar 40-4.

The steps resulting in controlled release of collar 40-3 from below collar 40-4 are repeated, in turn, for each of the collars 40-3 through 40-n, and a rug partaking of a gravity descent to the display site 16 until a displayed rug is selected by the customer and manually removed from its grid 30, and replaced by a duplicate or other rug. The partial or full stack 12 at the floor display site is then raised to the clearance position 42 as previously described, and the display and rug selection process repeated.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For a point-of-sales rug selection from a stack thereof, a method of stack separation to facilitate said selection comprising the steps of:

A. Stacking in adjacent superposed relation a select number of rugs on cooperating horizontal supports;

B. Attaching an end of a lifting and lowering cable to a lowest-most positioned horizontal support of said stack and threading a length portion thereof through remaining said horizontal supports for establishing an operative connection to a motor-operated cable winding and unwinding means;

C. Lifting said stack by said cable-connected lowest-most horizontal support to a clearance position above a floor rug display site using a winding mode of said motor-operated means;

D. Lowering only said cable-connected horizontal support from said stack using an unwinding mode of said motor-operated means incident to simultaneously display said rug thereon at said floor display site and establish a vertical orientation of said cable length portion in a taut condition extending to said lowest-most horizontal support; and E. Allowing gravity descent, from the bottom of said raised stack of a horizontal support one at a time to partake of tracking along said vertically oriented taut cable length portion;

Whereby said tracking along said taut cable length portion guides said rugs on said horizontal supports to said floor display site for successive display thereat.

* * * * *